US005516414A

United States Patent [19]

Glafenhein et al.

[11] Patent Number: 5,516,414

[45] Date of Patent: May 14, 1996

[54] METHOD AND APPARATUS FOR ELECTROLYTICALLY PLATING COPPER

[75] Inventors: Karl L. Glafenhein, Danville; David A. Murphy, Harrodsburg; Charles N. White, Stanford, all of Ky.; Shunji Hachisuka, Ibaraki, Japan

[73] Assignee: ATR Wire & Cable Co., Inc., Danville, Ky.

[21] Appl. No.: 240,671

[22] PCT Filed: Sep. 15, 1992

[86] PCT No.: PCT/US92/07808

§ 371 Date: Oct. 11, 1994

§ 102(e) Date: Oct. 11, 1994

[87] PCT Pub. No.: WO94/06953

PCT Pub. Date: Mar. 31, 1994

[51] Int. Cl.[6] ..... C25D 7/00; C25D 3/38; C25D 17/00

[52] U.S. Cl. ..... 205/50; 205/291; 205/295; 204/242; 204/275; 106/1.18

[58] Field of Search ..... 205/295, 291, 205/50; 204/433, 275, 242; 106/1.18

[56] References Cited

U.S. PATENT DOCUMENTS

| | | | |
|---|---|---|---|
| 2,250,556 | 7/1941 | Stareck et al. | 204/52 |
| 3,475,293 | 10/1969 | Haynes et al. | 204/48 |
| 3,775,268 | 11/1973 | Fino et al. | 204/52 R |
| 3,833,486 | 9/1974 | Nobel et al. | 204/44 |
| 4,904,354 | 2/1990 | Stavitsky et al. | 205/138 |
| 5,100,517 | 3/1992 | Starinshak et al. | 205/138 |
| 5,143,593 | 9/1992 | Ueno et al. | 205/291 |

OTHER PUBLICATIONS

Chemical Abstracts, vol. 74, No. 22, May 31, 1971, 119457x.

Chemical Abstracts, vol. 107, No. 6, Aug. 10, 1987 48270t.

Chemical Abstracts, vol. 107, No. 6, Aug. 10, 1987 119457x.

*Primary Examiner*—Kathryn Gorgos
*Attorney, Agent, or Firm*—King & Schickli

[57] ABSTRACT

A method for electrolytically plating copper onto a base metal, such as steel (18), utilizing an insoluble anode (16) includes the steps of: providing a pyrophosphate plating solution (14); adding a copper source, copper hydroxide, to the plating solution (14); and passing an electric current through the plating solution between the insoluble anode (16) and the base metal (18) to be plated. The apparatus (10) includes a plating tray (12), a pyrophosphate plating solution (14) including a soluble source of copper, an insoluble anode (16) and a power source (20). A copper plated product (P) is also disclosed and claimed.

21 Claims, 1 Drawing Sheet

METHOD AND APPARATUS FOR ELECTROLYTICALLY PLATING COPPER

TECHNICAL FIELD

The present invention relates generally to the plating field and, more particularly, to a unique method and apparatus for plating copper onto a base metal such as steel utilizing an insoluble electrode and copper ions from a plating solution.

BACKGROUND OF THE INVENTION

Steel, plated with copper, is utilized for a wide variety of applications. For example, copper plated steel wire is utilized for tire cord in steel radial tires, in high pressure hoses and belts and has other related applications.

Prior art electrolytic copper plating methods have utilized plating solutions commonly formed from copper pyrophosphate and copper sulfate. The copper pyrophosphate solution is understood to be pH neutral and is often preferred over the pH acidic solution of copper sulfate. No matter which solution is selected, however, prior art apparatus and methods have utilized soluble copper anodes.

For example, oxygen-free copper metal is usually utilized in a soluble anode in a copper pyrophosphate plating solution. The anode is placed on a positive charged electrode basket made of titanium or stainless steel. During plating, the anode changes shape. More specifically, copper dissolves from the anode to replace copper consumed from the solution to plate the steel. This change in shape, disadvantageously, results in relatively large variations in the current density at the steel being plated (functional cathode). This leads to uneven plating on the steel. Accordingly, plating quality is adversely effected.

An additional drawback to the utilization of soluble anodes is the need to periodically provide replacement as the copper of the anodes becomes exhausted. This is an inconvenient, relatively time consuming and usually unpleasant task. In many plating operations, it also may require some downtime which adversely effects productivity.

In others, and particularly continuous plating operations, "sparking" may occur during anode replacement. Sparking results when the anode simultaneously contacts both the electrode basket (positive charge) and the steel being plated (negative charge). Sparking creates a surface defect which is detrimental to the finish of the plated product.

SUMMARY OF THE INVENTION

Accordingly, it is a primary object of the present invention to provide an improved method and apparatus of copper plating specifically overcoming the above-described limitations and disadvantages of the prior art.

A more specific object of the present invention is to provide a novel copper plating method and apparatus providing significantly enhanced characteristics including more uniform plating over the entire surface being plated.

Still another object of the invention is to provide a method and apparatus for plating copper on steel that substantially eliminates the downtime and lost productivity associated with the replacement of soluble anodes in non-continuous plating operations.

Yet another object of the invention is to provide a plating method and apparatus utizling insoluble anodes so as to provide for the elimination of the sparking problem commonly occurring when soluble anodes as utilized in the prior art are replaced during continuous plating operations. As a result, the surface defects associated with sparking are virtually eliminated and, accordingly, a product of improved overall quality is produced.

A still further object of the invention is to provide a method and apparatus for copper plating steel wherein an insoluble anode is utilized and a separate copper source is added to the plating solution as required to provide a high quality, consistent and uniform plating operation. Further, this is achieved while eliminating the need to periodically replace the anodes thereby eliminating this unpleasant task.

Yet another object of the invention is to provide a copper plated steel product of improved quality produced in accordance with the present method.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a novel method for electrolytically plating copper onto any base metal upon which copper may be plated is provided. The method utilizes a plating apparatus including a power source, a plating tray and an insoluble anode.

More particularly, the method includes the providing of a pyrophosphate plating solution in the plating tray. Preferably, the pyrophosphate plating solution is formed from water, 200–400 grams per liter of tetrapotassium pyrophosphate ($K_4P_2O_7$) and 40–60 grams per liter of copper pyrophosphate ($Cu_2P_2O_7$). Additionally, the plating solution includes between 0–3 grams per liter of polyphosphoric acid. The addition of this acid allows an adjustment to be made to the initial pH of the plating solution. Specifically, the initial pH is brought to between 7 and 10 so as to make a selected copper source soluble therein.

Thus, the method also includes the step of adding a copper source to the plating solution. Preferably, the copper source is copper hydroxide ($Cu(OH)_2$). Advantageously, the copper hydroxide is fully soluble in the pyrophosphate plating solution and effectively serves to provide copper ions for plating and hydroxide ions for reacting with hydrogen ions produced during the plating process. Accordingly, the copper hydroxide functions to maintain the pH level of the plating solution relatively constant during the plating process while producing water as the neutralization reaction product. Advantageously, the water byproduct of the plating process is easily handled in an environmentally safe manner. Further, it should be appreciated that there is no buildup of precipitates or hazardous neutralization products in the plating solution even after continuous operation over an extended period of time.

Plating is completed by passing an electric current through the plating solution between the insoluble anode and the base metal, e.g. steel, to be plated. This current effectively drives the plating process. As copper ions are plated from the solution onto the steel, they are replaced in the plating solution by the addition of more copper hydroxide. Specifically, during the plating process, a concentration of between 21.5–33.8 grams per liter of copper hydroxide is maintained in the plating solution. Advantageously, this level of copper hydroxide also serves to maintain the plating solution at a pH of between 7–10; a range in which copper hydroxide is soluble in the pyrophosphate plating solution.

For the most efficient and effective plating, a current density of substantially 8–10 and more preferably 9 amps/$dm^2$ is maintained by passing an electric current of substantially 50 amperes at substantially 8 volts. Additionally, the plating solution is maintained at a temperature of between 45° and 55° and more preferably substantially 50° C. Further, the concentration of copper in the plating solution is maintained between 14 and 22 grams per liter and more preferably at substantially 20 grams per liter. Advantageously, as the plating process is completed with an insoluble anode that maintains a constant shape and mass, the current density does not fluctuate, and accordingly, a very uniform and high quality plating of copper on steel is achieved. Further, as there is no need to replace anodes and the process may be completed in a continuous manner, the prior art problem of sparking is effectively eliminated and accordingly, surface defects associated therewith are also eliminated. Excellent productivity is also assured.

In accordance with a further aspect of the present invention, an apparatus for copper plating a base metal such as steel is also provided. The apparatus includes a plating tray formed from a non-corrosive material such as stainless steel. A pyrophosphate plating solution of the type described above including a source of copper for plating is held in the plating tray. Additionally, an insoluble anode or anodes are installed in the plating tray and covered with the plating solution. Preferably, the anodes are made of titanium (Ti) coated with either iridium dioxide ($IrO_2$) or a combination film of iridium dioxide and platinum (Pt).

Still further, the apparatus includes a power source, such as a rectifier, for passing electric current through the plating solution between the anode and the steel so as to plate copper from the solution onto the steel in a uniform manner.

In a more preferred arrangement, the apparatus also includes a separate dissolving tank particularly adapted for dissolving copper hydroxide into a pyrophosphate plating solution. A conduit provides fluid communication between the dissolving tank and the plating tray. A pump serves to supply plating solution including copper hydroxide from the dissolving tank to the plating tray thereby replenishing the copper supply for plating as needed.

Additionally, the apparatus includes pH monitors for monitoring the pH of the plating solution in the plating tray and the pH of the plating solution in the dissolving tank. As the pH of the plating solution approaches the lower end of the pH range 7–10 in the plating tray, it is necessary to pump plating solution including relatively higher levels of copper hydroxide and, accordingly, an associated higher pH from the dissolving tank to the plating tray. In this way, the desired pH range and levels of copper hydroxide are maintained throughout the plating process.

Finally, in accordance with yet another aspect of the present invention, a copper plated steel product produced in accordance with the method described above is provided. The product is characterized by a uniform, high quality copper plate finish.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Figure 1:
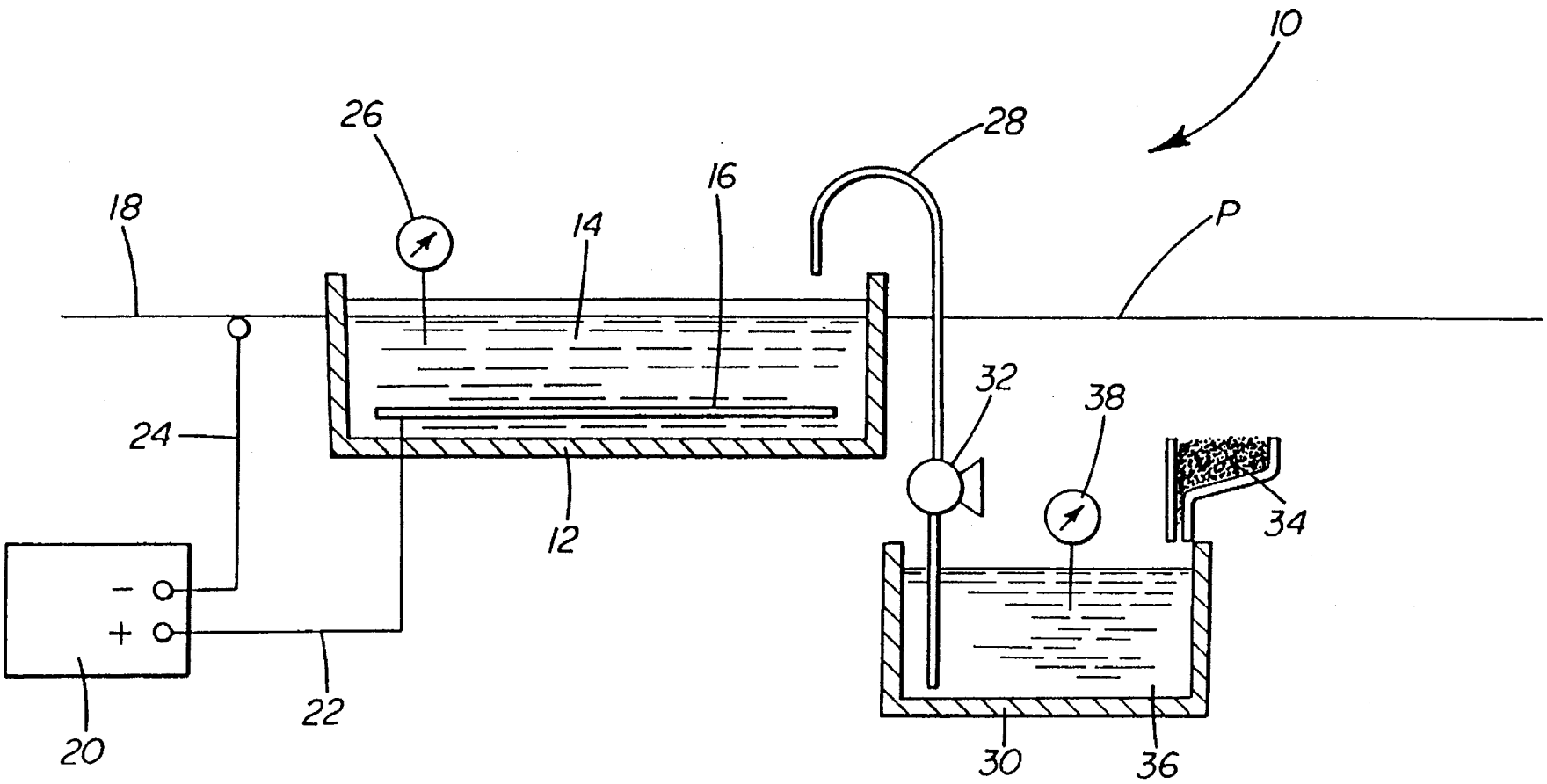
FIG. 1 is a schematical representation of the apparatus of the present invention.

Reference will now be made in detail to the present preferred embodiment of the invention, an example of which is illustrated in the accompanying drawing.

DETAILED DESCRIPTION OF THE INVENTION

Reference is now made to drawing FIG. 1 showing the apparatus 10 of the present invention for plating copper onto a base metal upon which copper may be plated. The apparatus 10 and method are described with reference to plating steel wire 18. It should be recognized, however, that other metals may be plated and that steel is only being referenced for purposes of illustration.

As shown, the apparatus 10 includes a plating tray 12 that is filled with a plating solution 14, such as a pyrophosphate solution. The pyrophosphate plating solution 14 preferably includes: water; between 200– 400 grams per liter of tetrapotassium pyrophosphate ($K_4P_2O_7$); between 40–60 grams per liter of copper pyrophosphate ($Cu_2P_2O_7$); and between 0–3 grams per liter of polyphosphoric acid. More preferably, the plating solution 14 includes substantially: 300 grams per liter tetrapotassium pyrophosphate; 56 grams per liter copper pyrophosphate; and 1 grams per liter polyphosphoric acid. For best results, the solution is maintained during plating at 45°–55° C. and more preferably, substantially at 55° C.

One or more anodes 16 are provided near the bottom of the plating tray 12 in the plating solution 14. Each anode 16 is of the insoluble type, preferably formed from titanium (Ti) coated by iridium dioxide ($IrO_2$), or a combination film of iridium dioxide and platinum (Pt).

The steel 18 to be plated is passed through the plating tray 12 below the surface of the plating solution 14 in a manner known in the art as shown. For example, the steel 18 may be in the form of wire having a diameter of 1.0–2.0 mm. The steel 18 is maintained in the plating solution 14 during processing for a total time of approximately 40–50 and more preferably 45 seconds. When a continuous steel wire 18 is plated, the wire may be moved through the solution 14 in the plating tray 12 at a speed of at least up to 2.6 m/min. depending upon the length of the plating tray, the desired depth of plating and the current density being utilized.

The power required to complete the plating operation is provided by means of a power source 20, such as a rectifier. The rectifier 20 includes a positive lead 22 electrically connected to the anode 16 and a negative lead 24 electrically connected to the steel 18 (functional cathode) to provide consistent/constant current density of substantially 8– 10 and more preferably 9 amps/$dm^2$. Preferably, electric current is passed through the plating solution at a level of substantially 50 amps at substantially 8 volts. This causes copper ions in the plating solution 14 to form onto and plate the steel 18.

As the copper ions are consumed from the plating solution 14, they must be replaced. Since the anode 16 is insoluble, another source of copper must be provided. To this end, a copper source is provided directly to the plating solution 14.

Specifically, the copper source is preferably soluble in the plating solution 14. As the pyrophosphate plating solution includes hydrogen ions ($H^+$), conventional copper sources such as copper (Cu), or copper oxide (CuO) are insoluble and will not function properly.

While copper carbonate ($CuCO_3$) is soluble in the pyrophosphate solution, it does not function in a desirable manner as its use leads to the rapid formation of carbonic acid. As a result, the change in pH occurring in the plating solution 14 generated by plating cannot be neutralized by the copper carbonate. Thus, the pH continues to be decreased eventually to a level effectively blocking the plating and corroding the steel 18. While chemicals may be added to the plating solution 14 to neutralize the pH drop, carbonates still build up. Eventually, they could reach sufficiently high levels to precipitate and require cleaning from the plating tray. The downtime necessary to do this would adversely effect productivity and, accordingly, copper carbonate is also not a suitable copper source.

Copper hydroxide ($Cu(OH)_2$), however, may be utilized as the copper source in the pyrophosphate plating solution 14. More particularly, when the pH of the pyrophosphate solution is maintained between 7–10, more preferably between 8–9 and most preferably between 8.1–8.4, the copper hydroxide is soluble in the plating solution.

During plating, the pH of the solution 14 decreases. Specifically, as shown in the following formula, hydrogen ions are produced by the plating process:

$$Cu^{2+}+H_2O \leftrightarrows 2H^++\tfrac{1}{2}O_2\uparrow+Cu^o \text{ (plated)}$$

Advantageously, as shown in the following formulae, copper hydroxide provides the necessary hydroxide ions to counteract or balance the hydrogen ions generated during plating:

$$Cu(OH)_2 \leftrightarrows Cu^{2+}+2(OH)^-$$

leading to the neutralization reaction:

$$2H^++2OH^- \rightarrow 2H_2O$$

Thus, when copper hydroxide is utilized as the source of copper in the pyrophosphate plating solution 14, the net reaction is:

$$Cu(OH)_2+H_2O \leftrightarrows 2H_2O+\tfrac{1}{2}O_2\uparrow+Cu^o \text{ (plated).}$$

Accordingly, it should be appreciated that as long as copper hydroxide is added to the plating solution 14 in sufficient quantities to replace or offset the copper consumed from the solution in the plating process, the pH of this solution is maintained at a constant level.

In order to achieve this end, copper ions from the copper source are maintained in the solution 14 at a concentration of between 14–22 grams per liter and preferably substantially 20 grams per liter. Thus, where copper hydroxide is utilized as the copper source, a concentration of between 21.5–33.8 grams per liter and preferably substantially 30.7 grams per liter is maintained.

Of course, there will be some fluctuation in pH in the plating solution 14 during plating due to momentary fluctuations in copper hydroxide concentration, water evaporation and solution spillage. Accordingly, a pH monitor 26, of any appropriate type known in the art, is provided to monitor the pH of the solution in the plating tray 12. As the level decreases to the lower end of the desired range (pH 7– 10), more copper hydroxide is added to the solution to maintain the necessary operating parameters for continuing the plating process.

Preferably, the copper hydroxide is added through a conduit 28, leading from a dissolving tank 30, by means of a pump 32. More specifically, copper hydroxide powder 34 is added into a copper pyrophosphate solution 36 maintained at 45°–55° C. (preferably 50° C.) and having a pH between 7–10 substantially corresponding to that in the plating tray 12. An agitator (not shown) may be provided, if desired, to aid in the dissolving process. Additionally, a second pH monitor 38 is provided to monitor the pH of the pyrophosphate solution 36 in the dissolving tank 30. Thus, it should be appreciated that it is possible to add copper hydroxide in solution 36 at the desired concentration and pH from the dissolving tank 30 into the plating tray 12 as required to maintain the best conditions for providing the highest quality plating.

Further, as an insoluble anode 16 is utilized that maintains its shape at all times during the plating process, there are no significant fluctuations in current density as often occur when utilizing soluble anodes. Thus, consistent, even plating of uniform thickness is ensured. Additionally, the need to replace exhausted soluble anodes is eliminated. Accordingly, the potential for sparking and the plating defects resulting therefrom are avoided.

Briefly summarizing, the method for plating steel with copper includes providing a pyrophosphate plating solution 14 of the type described in a plating tray 12 during plating, the pH of the solution is maintained between 7–10, more preferably between 8–9 and most preferably between 8.1–8.4. This is accomplished by adding copper hydroxide to the solution. The copper hydroxide advantageously provides both copper to the solution for plating and hydroxide ions for reacting with hydrogen ions produced during plating. In fact, the ratio of the presentation of hydroxide ions to hydrogen ions is 1:1 so that a pH stable solution is effectively provided. Finally, the plating process is driven by passing an electric current of substantially 50 amps at 8 volts through the plating solution. This provides a constant current density of 8–10 and preferably 9 amps/dm$^2$. A high quality copper plated steel product P with uniform plate thickness is produced by this method.

An example is presented below to further illustrate the invention.

EXAMPLE 1

An insoluble metal anode (titanium anode coated with $IrO_2$, thickness 20 g/m$^2$, as available from Nisshin Kasei Company of Japan, model NY type) was installed in an non-corrosive plating tray. Next, 250 l of plating solution including 300 grams per liter of $K_2P_2O_7$, 56 grams per liter $Cu_2P_2O_7$, 20 grams per liter $Cu(OH)_2$ and 1 gram per liter polyphosphoric acid (total pyrophosphates 175 grams per liter), was added to the plating tray. The tray was 2,000 mm in length, 300 mm in width and 150 mm in depth. The solution was brought to and maintained at a temperature of 50° C. during the plating operation. The pH of the solution was 8.1 at the start of the process and maintained as close to that level as possible throughout. To achieve this end, the pH of the solution was monitored utilizing a digital pH meter as available from Horiba Seisakusho of Japan. As the pH began to drop during plating, copper hydroxide in a pyrophosphate solution was pumped from a dissolving tank into the plating solution in the plating tray. The dissolving tank had a capacity of 880 l and including a Cu content of powder of 61% allowing Cu deposit by plating of 100 kg/day. The amount of copper hydroxide utilized at this rate was 164 kg/day or 6.8 kg/hour. Maximum dissolving of copper was 5.0 grams per liter.

Steel wire, having a diameter of 1.68 mm was positioned in the plating solution adjacent the top of the plating tray. The wire was moved through the plating tray at 2.6 m/min and had a dipping time of 45 seconds. The wire and anode were connected to the negative and positive leads, respectively of a rectifier (model FBS-080-500, available from Chuo Seisakusho of Japan) set to an amperage of 9.5 amps at substantially 5.0 volts. Accordingly, a constant current density of 9 amps/dm$^2$ was provided. This produced a plating weight of 2.1 grams of copper per kilogram of steel. The resulting plating was consistently applied and of uniform depth.

In summary, numerous benefits result from employing the concepts of the present invention. The method and apparatus simplify the plating process by eliminating the need to monitor and replace exhausted soluble copper electrodes. Accordingly, the potential problem of sparking is avoided. Further, as an insoluble anode is utilized, a constant current density results. This means that the plating is uniformly and evenly applied over the steel being processed.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A method for electrolytically plating copper onto a base metal utilizing a plating apparatus including a power source and a plating tray, comprising the steps of:

providing a pyrophosphate plating solution in said plating tray;

providing an insoluble anode in said plating solution;

passing an electric current through said plating solution between said insoluble anode and said base metal; and adding copper hydroxide to said plating solution to maintain a concentration of copper hydroxide in said plating solution of at least 21.5 grams/liter and a pH between substantially 7–10 so that a substantially constant current density is maintained and copper from said solution is plated onto said base metal in a uniform manner.

2. The method set forth in claim 1, wherein said pyrophosphate plating solution is formed from water, 200–400 grams per liter of tetrapotassium pyrophosphate ($K_4P_2O_7$) and 40–60 grams per liter of copper pyrophosphate ($Cu_2P_2O_7$).

3. The method set forth in claim 2, wherein said pyrophosphate plating solution further includes between 0–3 grams per liter of polyphosphoric acid.

4. The method set forth in claim 1, including maintaining a concentration of 21.5–33.8 grams per liter of copper hydroxide in said plating solution.

5. The method set forth in claim 4, including maintaining said plating solution at a temperature of between 45°–55°.

6. The method set forth in claim 4, including passing electric current through said plating solution between said insoluble anode and said base metal to be plated at substantially 50 amps at substantially 8 volts to provide a current density of substantially 8–10 amps/dm$^2$.

7. The method set forth in claim 1, including maintaining a concentration of copper in said plating solution between 14–22 grams per liter.

8. The method set forth in claim 1, including maintaining a concentration of copper in said plating solution at substantially 20 grams per liter.

9. The method set forth in claim 1, including maintaining a concentration of 30.7 grams per liter of copper hydroxide in said plating solution.

10. The method set forth in claim 9, including maintaining the temperature of said plating solution between 45°–55° C.

11. The method set forth in claim 10, including passing electric current through said plating solution between said insoluble anode and said base metal to be plated at substantially 50 amps at substantially 8 volts to provide a current density of substantially 8–10 amps/dm$^2$.

12. A copper plated product produced in accordance with the method set forth in claim 1.

13. A copper plating solution, comprising:

200–400 grams per liter of tetrapotassium pyrophosphate;

40–60 grams per liter of copper pyrophosphate;

21.5–33.8 grams per liter of copper hydroxide; and

0–3.0 grams per liter of polyphosphoric acid;

said plating solution also having a pH between 7–10.

14. A copper plating system for copper plating a base metal, comprising:

(a) a bath including;

a pyrophosphate plating solution providing a source of copper for plating, said source of copper being copper hydroxide at a concentration of between substantially 21.5–33.8 grams/liter and said plating solution having a pH between substantially 7–10; and (b) an apparatus including;

a plating tray for holding the pyrophosphate plating solution;

an insoluble anode received in the pyrophosphate plating solution held in the plating tray; and a power source for passing electric current through said pyrophosphate plating solution between said anode and said base metal to plate copper from said solution onto said base metal in a uniform manner.

15. The copper plating system set forth in claim 14, wherein said pyrophosphate plating solution is formed from tetrapotassium pyrophosphate and copper pyrophosphate.

16. The copper plating system set forth in claim 15, wherein said pyrophosphate plating solution includes between 200–400 grams per liter of tetrapotassium pyrophosphate and 40-60 grams per liter copper pyrophosphate.

17. The copper plating system set forth in claim 15, wherein said pyrophosphate solution includes substantially 300 grams per liter tetrapotassium pyrophosphate and substantially 56 grams per liter copper pyrophosphate.

18. The copper plating system set forth in claim 14, wherein said power source is a rectifier providing substantially 50 amps at substantially 8 volts.

19. The copper plating system set forth in claim 14, further including a dissolving tank for dissolving copper hydroxide into said plating solution.

20. The copper plating system set forth in claim 19, further including a conduit providing fluid communication between said dissolving tank and said plating tray and a pump for supplying plating solution from said dissolving tank to said plating tray.

21. The copper plating system set forth in claim 14, further including a pH monitor for monitoring said pH of said plating solution in said plating tray.

* * * * *